US005337904A

United States Patent [19]

Goldberg

[11] Patent Number: 5,337,904

[45] Date of Patent: Aug. 16, 1994

[54] STORAGE AND DISPLAY RACK

[76] Inventor: Lewis B. Goldberg, 20768 Skouras Dr., Canoga Park, Calif. 91306

[21] Appl. No.: 61,747

[22] Filed: May 17, 1993

[51] Int. Cl.[5] ..... A47F 7/00

[52] U.S. Cl. ..... 211/13

[58] Field of Search ..... 211/13, 74, 77, 188, 211/194, 205

[56] References Cited

U.S. PATENT DOCUMENTS

| | | | |
|---|---|---|---|
| 117,765 | 8/1871 | Gibson | 211/77 |
| 353,554 | 11/1886 | Godfrey | 211/77 |
| 2,946,456 | 7/1960 | Liguori | 211/77 |
| 4,848,609 | 7/1989 | Meghnot | 211/13 |
| 4,893,222 | 1/1990 | Mintzer | 211/13 X |
| 4,991,892 | 2/1991 | Burrell | 211/13 X |

*Primary Examiner*—Alvin C. Chin-Shue
*Assistant Examiner*—Sarah A. Lechok
*Attorney, Agent, or Firm*—Allan M. Shapiro

[57] ABSTRACT

A storage and display rack which has a base plate, a spreader plate thereabove, and a holder at the top which is provided with devices to engage electronic remote control devices and the like to permit storage, display and ready removability of remote control devices for accessibility and use.

18 Claims, 2 Drawing Sheets

STORAGE AND DISPLAY RACK

FIELD OF THE INVENTION

This invention is directed to a rack which is fitted for engagement by electronic remote control devices for the display thereof and the removable storage thereof so that the electronic remote control devices are easily accessible.

BACKGROUND OF THE INVENTION

In the modern home, there are many electronic devices which can be remotely controlled. Most of these are entertainment electronic devices. Television sets, video cassette recorders, laser disc players, audio tape players, and compact disc players are each available with an electronic control system which can be remotely controlled. There are also other types of home entertainment electronic devices and other types of electronic devices which can be and/or are equipped with remote control devices. In a well-equipped home entertainment center, there are thus many different controllable electronic devices for audio and/or visual entertainment. In most cases, each of these devices has its own remote controller. It is a burden to attempt to keep the remote controllers organized so that they are each readily accessible, as needed. When all of the electronic control devices are placed together on a table for convenient accessibility, finding the right one is difficult. Thus, there must be a way to keep them organized, visible and accessible within easy reach so as to provide full convenience for the utilization of the control devices.

SUMMARY OF THE INVENTION

In order to aid in the understanding of this invention, it can be stated in essentially summary form that it is directed to a storage and display rack which has a support structure for a generally upright member. A holder is mounted adjacent the top of the upright member, and a spreader is mounted therebelow. Each electronic remote control device is equipped with an engagement device which inter-engages with a corresponding inter-engagement structure on the holder. The inter-engagement device and structure are suitable for detachably retaining the electronic device, and the spreader positions the electronic device for display.

It is, thus an object of this invention to provide a storage and display rack which detachably stores and displays a plurality of remote controlled electronic devices to position the devices for ready access and removability.

It is another object and advantage of this invention to provide a storage and display rack which has an inter-engagement structure thereon which interacts with an inter-engagement device on each of a plurality of remote control electronic devices so that the remote control electronic devices can be engaged thereon, displayed and removed therefrom, as required.

It is a further object and advantage of this invention to provide an economic storage and display rack which can be economically constructed and marketed so that it is widely available for the advantages of storage and display which it provides.

It is a further object and advantage of this invention to provide a storage and display rack which includes a base plate for support of the rack, a holder for detachable holding of a plurality of electronic remote control devices, and a spreader for holding the stored electronic remote control devices in a display and accessible position.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENT

Figure 1:
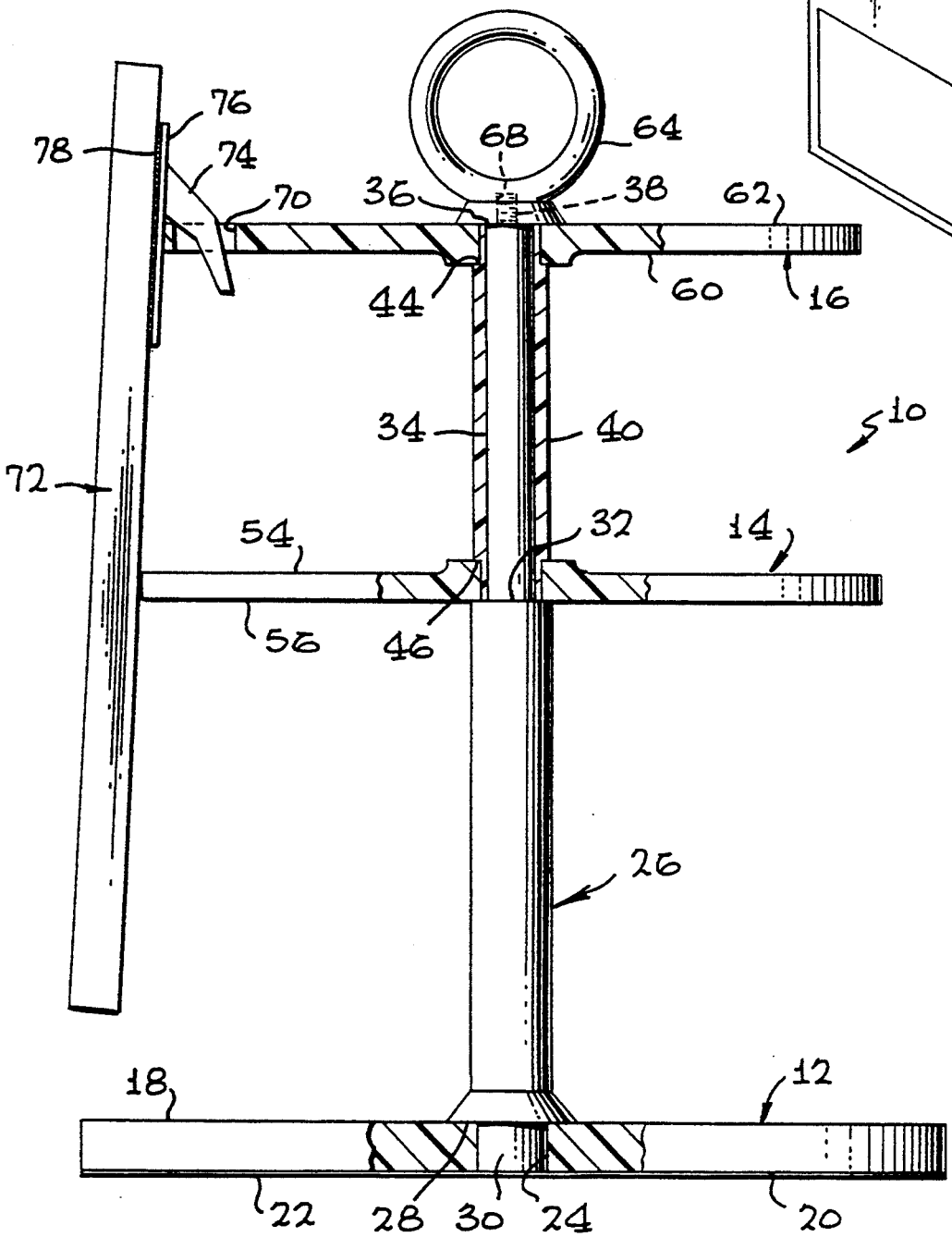
FIG. 1 is a side-elevational view of the storage and display rack of this invention, with parts broken away and parts taken in section.
Figure 3:
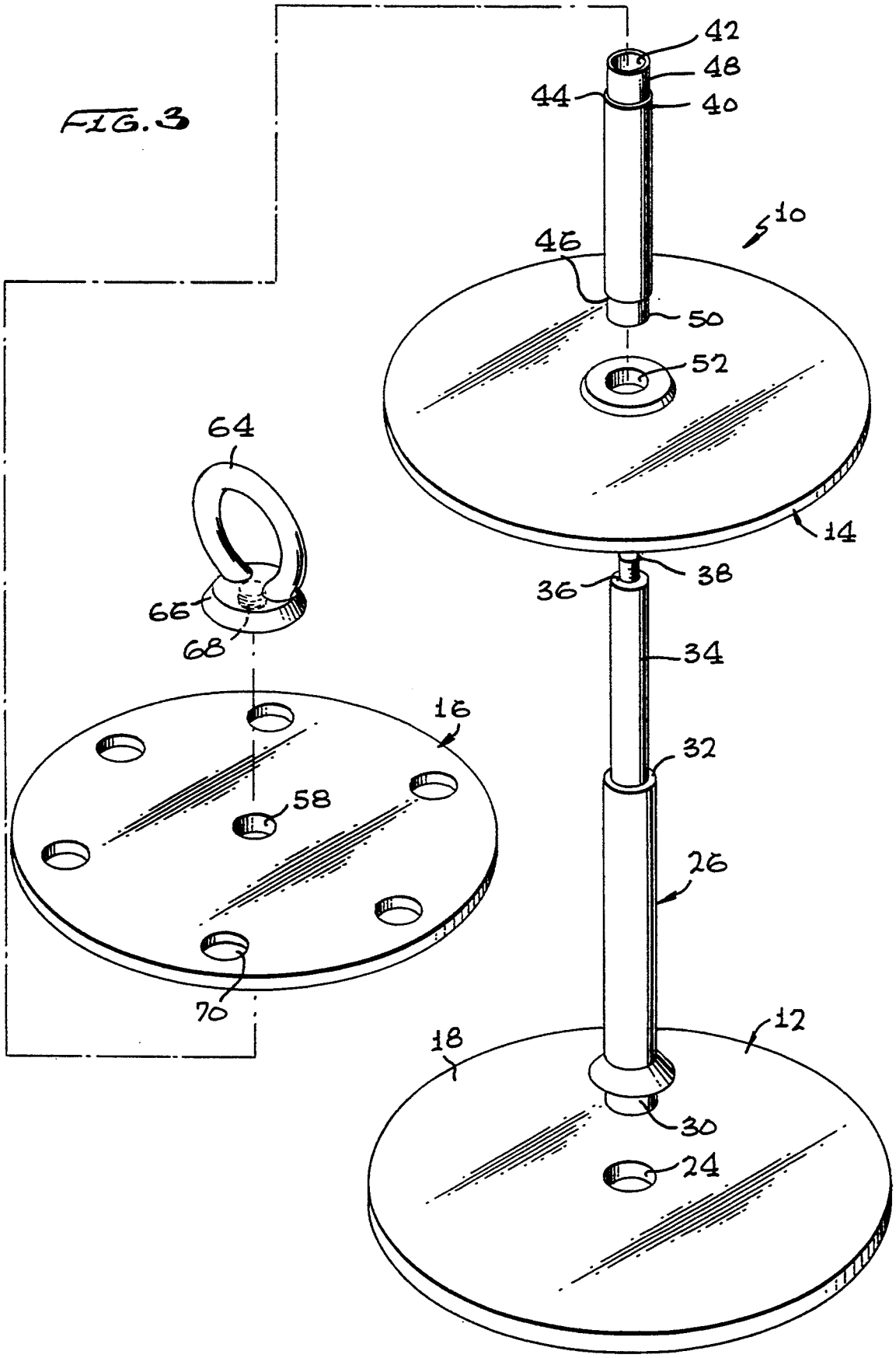
FIG. 3 is an exploded isometric view of the storage and display rack of this invention, on a smaller scale than the rack shown in FIG. 1.

The storage and display rack of this invention is generally indicated at 10 in FIGS. 1 and 3. The rack 10 is made up of a base plate 12 which serves as a support structure for the rack. Above the base plate, it comprises a spreader plate 14. Mounted on top of the spreader plate is holder 16. These parts are illustrated as being circular about a central axis, and such is the preferred configuration. Each is preferably made of synthetic polymer composition material which may be thermoplastic and injection-molded or which may be made of other synthetic or natural material and molded or machined to shape.

In the preferred embodiment, the base plate 12 is a circular disc having a top surface 18, a bottom surface 20, and a no-scratch pad 22 secured to the bottom surface. A felt or similar textile material is suitable for the pad 22, as is a resilient rubber-like sheeting material. Base plate 12 has a central opening 24 on the axis of the base plate.

Central rod 26 is an upright member which is mounted on the base plate and which supports the spreader plate and holder. Central rod 26 has a shoulder 28 which engages on the top surface 18. Nose 30 extends below the shoulder 28 and engages in central opening 24. It is screwed therein or is preferably permanently secured therein by means of adhesive attachment. Central rod 26 also has an uprightly directed shoulder 32. Above shoulder 32, central rod 26 extends in an upper section 34. The central rod 26 has a cylindrical surface about the axis, both above and below the shoulder 32. At the top of the central rod is top shoulder 36, which defines the upper limit of upper section 34. Threaded stud 38 extends upward from shoulder 36.

Spacer sleeve 40 has an interior opening 42 sized to receive the upper section 34. The spacer sleeve 40 has an upper shoulder 44 and a lower shoulder 46 which respectively have bosses 48 and 50 thereon.

Spreader plate 14 has a central opening 52 therein which receives the boss 50. Shoulder 46 engages on the top surface 54 of spreader plate 14. The lower surface 56 rests against shoulder 32. This engagement both radially and axially positions spreader plate 14. As seen in FIG. 3, the spreader plate 14 is preferably circular around the axis, and is of a diameter as discussed below.

Holder plate 16 also has an interior opening 58 on its axis. The opening 58 is sized to engage on boss 48. The shoulder 44 engages against the under surface 60 of the holder, as seen in FIG. 1. Stud 38 extends above the top surface 62, as seen in FIG. 1.

Ring 64 is mounted on flange 66 which is sized to be larger than the opening 58. Threaded interior opening 68 in the flange is threaded to receive the threaded stud 38. Thus, when assembled, the ring 64 clamps the holder 16 down on the top of spacer sleeve 40 and also clamps the spreader plate 14 in place. The ring 64 is large enough for manual engagement so that the rack 10 can be manually engaged so that the rack can be raised and manually positioned. If desired, the ring could also be used for suspension of the rack.

Figure 2:
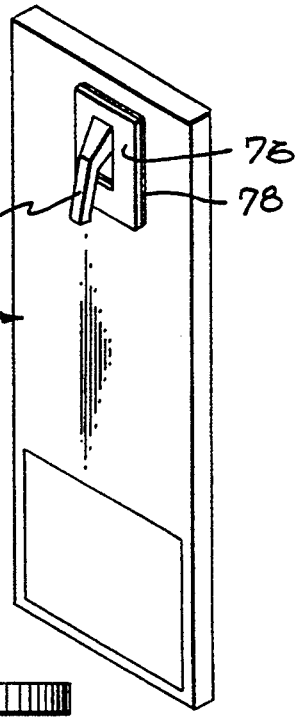
FIG. 2 is a rear isometric view of an electronic remote control device showing an inter-engagement device thereon which permits it to be stored and displayed on the rack of this invention.

The holder 16 is provided with inter-engaging structure. In the preferred embodiment illustrated, the inter-engaging structure on the holder comprises a plurality of spaced openings. Opening 70 is shown in FIGS. 1 and 3, and FIG. 3 shows that opening to be one of six equi-angularly spaced circular holes through the holder. Cooperating with the opening is an inter-engaging device on each of the electronic remote control devices. Electronic remote control device 72 is shown in FIGS. 1 and 2. On its back, the remote control device 72 carries a hook 74 which serves as an inter-engaging device to engage in one of the holes in the holder which form the inter-engaging structure. As seen in FIGS. 1 and 2, the hook is integrally formed on a flat base 76. The flat base is adhesively secured, such as by pressure-sensitive adhesive 78 to the back of the remote control device.

As far as sizes are concerned, holder 16 is sufficiently high above base plate 12 that the remote control device hanging on the holder does not reach sufficiently far down as to touch base plate 12. Furthermore, the diameter of holder 16 is sufficiently large so as to accommodate about six of the openings 70, and these openings are sufficiently spaced so that remote control devices can be engaged in adjacent holes without the remote control devices touching each other. It is seen from FIG. 1 that, if the remote control device 72 hung freely from its hook, its bottom would swing in toward the central rod 26. In order to provide for accessibility and more interesting display of the remote control devices, the diameter of spreader plate 14 is at least equal to the diameter of holder 16 and is preferably greater, as shown in FIG. 1.

With the storage and display rack is provided a plurality of the inter-engaging devices. One of the inter-engaging devices is adhesively attached to the back of each of the remote control devices which is to be displayed so that the hooks are positioned as generally shown in FIGS. 1 and 2. Thereupon, the user can hang his remote control devices on the storage and display rack for ease of accessibility. The storage and display rack can be positioned adjacent the user as he utilizes his electronic devices.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A storage and display rack comprising:

a base, said base being configured to support said rack;

a holder, said holder being configured to detachably retain a plurality of remote control devices dependent therefrom;

a spreader between said base and said holder, said spreader being positioned to be engaged by a remote control device depending from said holder to prevent the remote control device from swinging freely;

means for holding said spreader above said base and said holder above said spreader; and means for supporting a remote control device on said holder, said means comprising inter-engaging means on said holder and on a remote control device.

2. The storage and display rack of claim 1 wherein said inter-engaging device and structure comprise a hook and an opening sized to receive said hook.

3. The storage and display rack of claim 2 wherein said opening is in said holder and said hook is for attachment to a remote control device.

4. The storage and display rack of claim 3 wherein there is a plurality of holes around said holder adjacent the periphery thereof.

5. The storage and display rack of claim 4 wherein said holder and said spreader are each circular and said openings in said holder are each substantially equally angularly spaced around the periphery of said holder.

6. The storage and display rack of claim 5 wherein said base is also circular and further including a central post which defines an axis, said circular base, said circular spreader and said circular holder each being circular about said axis.

7. A storage and display rack comprising:

a base plate, said base plate being configured to support said storage and display rack on a supporting surface;

an upright post mounted on said base plate;

a spreader mounted on said post, intermediate the ends thereof;

a holder mounted on said post, said holder being spaced from said spreader and being positioned adjacent the top of said post, said spreader being at least as large as said holder, said spreader and said holder each having an external edge surface and said external edge surface of said spreader being of substantially the same configuration as said external edge surface of said holder; and inter-engaging structure on said holder and an inter-engaging device for attachment to a remote control device so that the remote control device can hang detachably pendant from said holder and being retained in a divergent position from a naturally pendant position so that a remote control device can be detachably stored and displayed on said rack.

8. The storage and display rack of claim 7 wherein there is a plurality of inter-engaging structures on said holder and there is a plurality of inter-engaging devices each for attachment to one of a plurality of remote control devices so that a plurality of remote control devices can be displayed and detachably stored on said rack.

9. The storage and display rack of claim 8 wherein said inter-engaging device comprises a hook engaging in a hole.

10. The storage and display rack of claim 9 wherein said hole is positioned in said holder and there is a plurality of spaced holes positioned around the periphery of said holder for the detachable storage and display of a plurality of remote control devices.

11. The storage and display rack of claim 10 wherein said device for attachment to a remote control device comprises a hook for engagement in one of said openings adjacent the periphery of said holder.

12. The storage and display rack of claim 11 wherein said holder and said spreader are each circular about an axis defined by said post and said holes in said holder are substantially equi-angularly spaced around said axis.

13. The storage and display rack of claim 12 wherein said spreader is larger than said holder.

14. The storage and display rack of claim 7 wherein said spreader is larger than said holder.

15. The storage and display rack of claim 7 wherein said post is mounted on said base and extends upward through an opening in said spreader and in said holder and there is means attached to the top of said post for retaining said spreader and said holder on said post.

16. The storage and display rack of claim 15 wherein said post has a shoulder and said spreader engages against said shoulder to position said spreader above said base and there is an upper shoulder adjacent the top of said post and said holder engages on said upper shoulder.

17. The storage and display rack of claim 16 wherein there is a sleeve on said central post and said sleeve engages on said spreader and said upper shoulders on said sleeve.

18. The storage and display rack of claim 17 wherein there is a ring engaged on the top of said post and on the top of said holder to retain said spreader and said holder on said post.

* * * * *